US005457830A

United States Patent [19]

Fox et al.

[11] Patent Number: 5,457,830

[45] Date of Patent: Oct. 17, 1995

[54] BED DIVIDER

[76] Inventors: Geoffrey J. Fox; Helaine A. Fox, both of 15 Chatterton Woods, Hamden, Conn. 06518

[21] Appl. No.: 278,415

[22] Filed: Jul. 21, 1994

[51] Int. Cl.[6] ..... A47G 9/02

[52] U.S. Cl. ..... 5/486; 5/496; 5/513

[58] Field of Search ..... 5/482, 486, 495, 5/497, 499, 513

[56] References Cited

U.S. PATENT DOCUMENTS 977,936 12/1910 Copeland et al. .
2,689,961 9/1954 Lieberthal .
2,730,728 1/1956 Roberts .
3,072,776 1/1963 Quenneville ..... 129/46
3,331,088 7/1967 Marquette .
3,530,516 9/1970 Marquette .
4,069,526 1/1978 Deikel ..... 5/486
4,802,250 2/1989 Farr ..... 5/495 X
5,201,086 4/1993 Decker et al. ..... 5/497 X
5,287,573 2/1994 Ritacco ..... 5/486

*Primary Examiner*—Michael F. Trettel
*Attorney, Agent, or Firm*—Charles Blaich

[57] ABSTRACT

Delineation of the centerline of a bed by incorporating visible and tactile decoration into the centerline of form fitted bottom sheeting.

3 Claims, 3 Drawing Sheets

BED DIVIDER

BACKGROUND OF THE INVENTION

One of the greatest banes that plague couples sharing a common bed is the ongoing battle of who is taking more than an equal share of the bed and/or bedding. This appears to be the source of ongoing arguments between couples and in the extreme leads to the final arguments and separation. Of course, depending upon a couple's temperment this may be taken humorously and result in only good natured chiding. Even so, this situation may grow out of proportion and result in heated verbal jabs and ultimately lead to substantive arguments.

OBJECT OF THE INVENTION

It is primary object of the invention to clearly delineate the midpoint of a common bed.

It is another object of the invention to tactually, clearly delineate the midpoint of a common bed.

It is yet another object of the invention to visibly, clearly delineate the midpoint of a common bed.

It is yet another object of the invention to provide interlocking means to delineate not only the shared bed but the bedding thereon.

PRIOR ART

The following art was found in a preliminary search for patentability:

| U.S. Pat. No. | Issue Date | Inventor |
|---|---|---|
| 977,936 | December 6, 1910 | Copeland et al. |
| 2,689,961 | August 21, 1952 | Lieberthal |
| 2,730,728 | January 17, 1956 | Roberts |
| 3,072,776 | January 8, 1963 | Quenneville |
| 3,331,088 | July 18, 1967 | Marquette |
| 3,530,516 | September 29, 1970 | Marquette |

Copeland et al. discloses bed sheeting made with a plurality of panels of a plurality of widths and stitching means to develop a lock stitch using a special sewing machine.

Lieberthal discloses a slideably disengageable split blanket for a double bed the object being that one of the bed's two occupants can fold that portion of the split blanket that covers them down while the second portion of the blanket covers the other person occupying the bed.

Roberts discloses a ⅓–⅔ split blanket for double beds so that the person requiring more warmth has ⅔ of the blanket's width for coverage vs. ⅓ of the blanket's width for the second person that requires less coverage.

Quenneville discloses a split bed cover which permits one occupant of a double bed the opportunity to cover themselves while the second occupant may throw off their covers. This without affecting the first person.

Marquette '088 discloses multiple thickness split double bed cover wherein the first occupant can peel each of the thicknesses and store according to the first person's needs. The second person may also do the same.

Marquette '516 discloses an improvement of the '088 patent above wherein each of the two (or more) halves of the split blanket may be joined with one or more halves each of which have varying degrees of thickness and may separately be purchased.

None of the art found in the search appears to be applicable to the instant invention.

SUMMARY OF THE INVENTION

In simplest form a visible decorative line may be printed at the center of a form fitted or contoured bottom sheet. When drawn onto the bed's mattress in such manner that the corners and sides of the sheet are properly fitted, the center line of the bed is defined. More elaborate tactually sensitive means such as cable stitching, embroidery, piping and the like may be used to define the centerline of the bed.

In yet more elaborate form a fastening means is applied to the center of fitted bottom sheet and the center of the upper bedding; the two interlocking to provide a physical centerline barrier.

DETAILED DESCRIPTION

Figure 1:
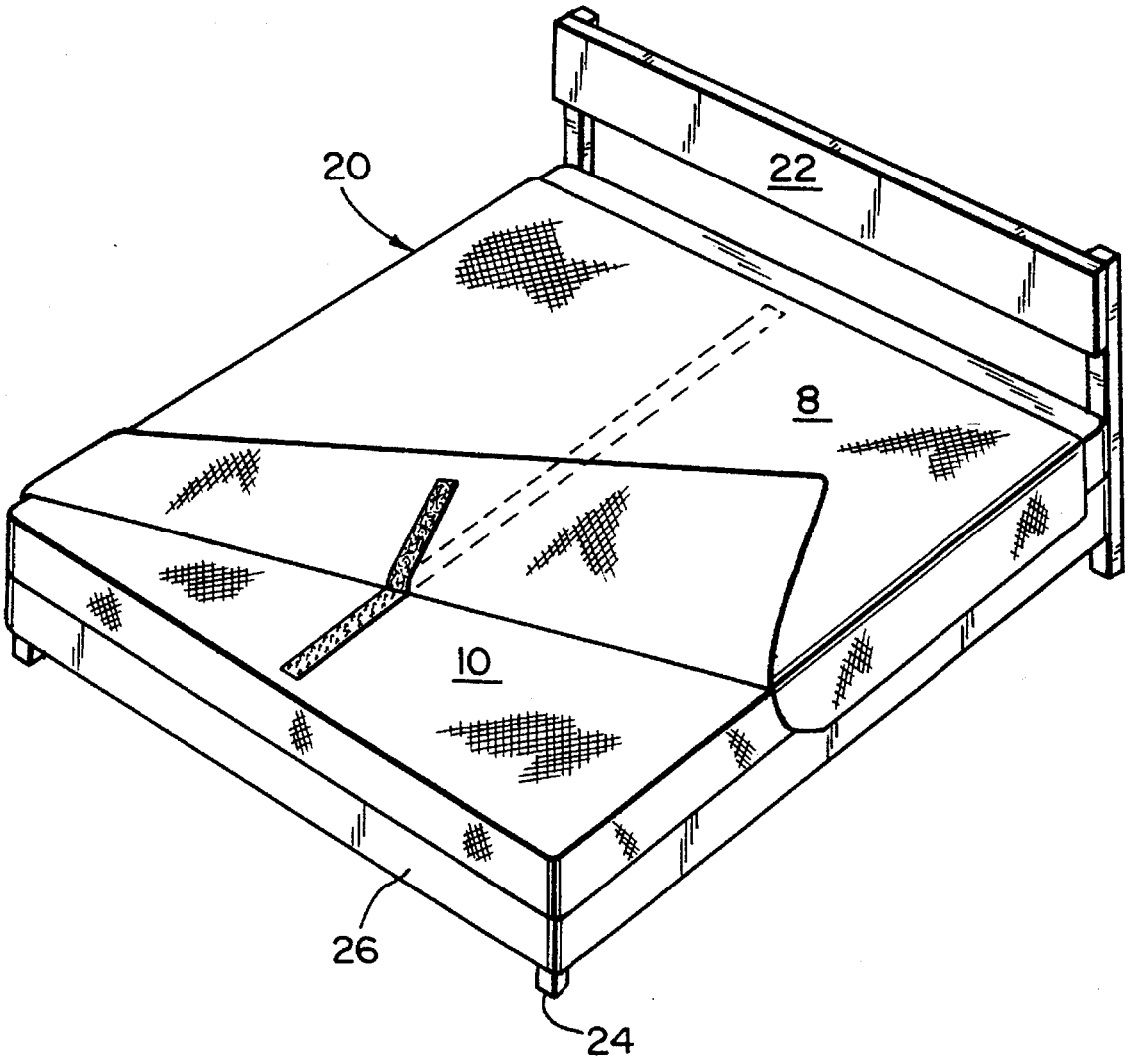
FIG. 1 illustrates a bed with hook and loop fastener on the centerline of the bed.

FIG. 1 the centerline of fitted bottom sheet 10 on bed 20 with headboard 22, legs 24, boxspring 26 has one part of a hook and loop fastener located thereon. The second part of the hook and loop fastener is located on the centerline of the underside of top sheet 8. When in place the hook and loop fastener effectively equally separated left and right portions of bed 20.

Figure 2:
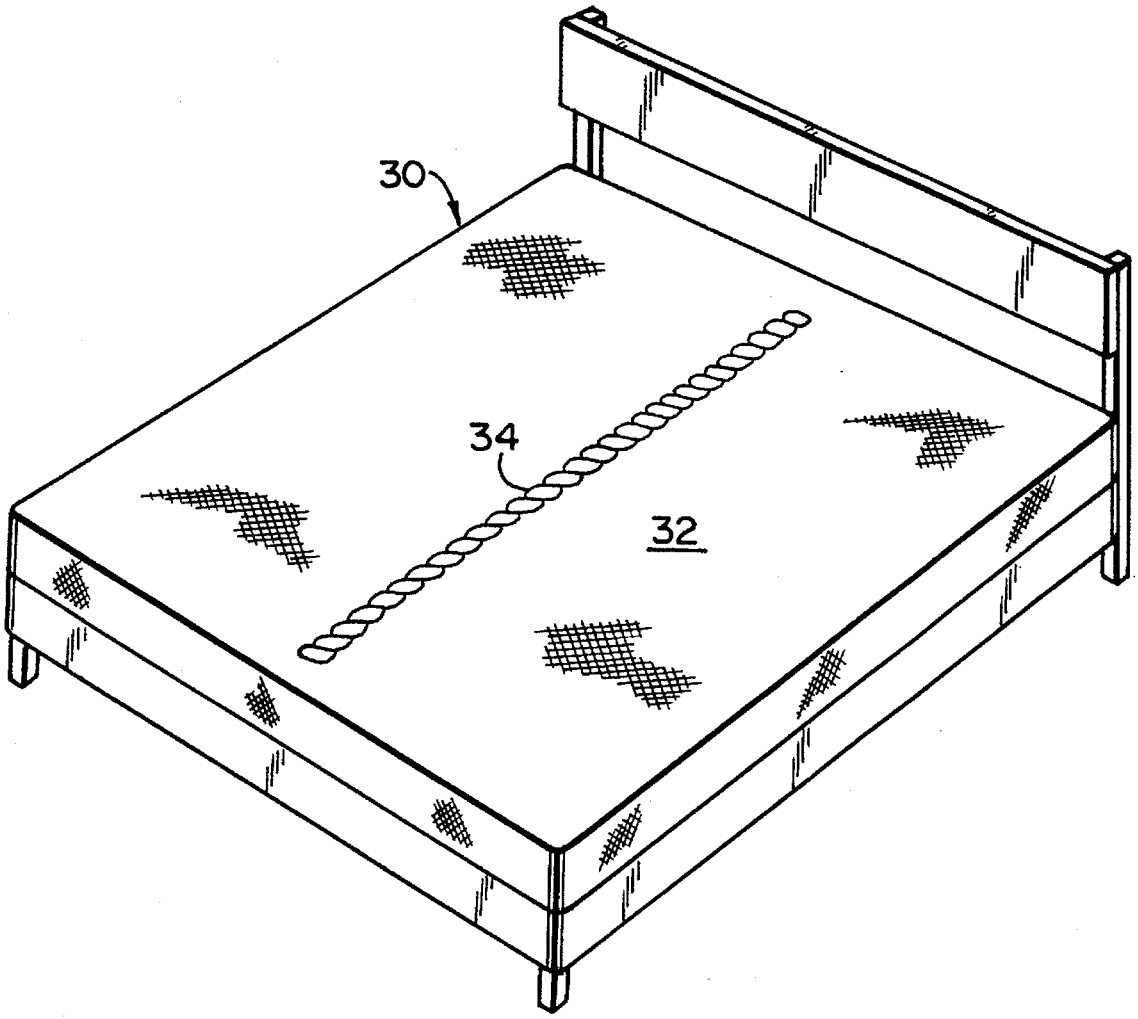
FIG. 2 illustrates a fitted bottom sheet with a raised cable stitch defining the centerline of a bed.

FIG. 2 illustrates a bed 30 with the fitted bottom sheet 32 which has cable stitching 34 extending along its centerline.

Figure 3A:
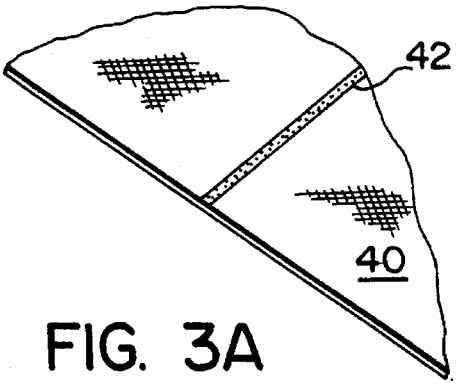
FIGS. 3A, 3B, 3C, 3D, and 3E illustrate various means of visually and tactually defining the centerline of a bed.

FIG. 3A illustrates a printed centerline on sheet 40. The printed centerline 42 may be of any color either to harmonize with bottom sheet 40 or in a disharmonious color to clearly define the centerline.

Figure 3B:
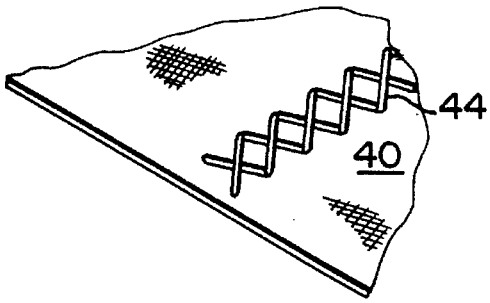

FIG. 3B illustrates the use of a crosshatch stitch 44 on bottom sheet 40 to define the centerline.

Figure 3C:
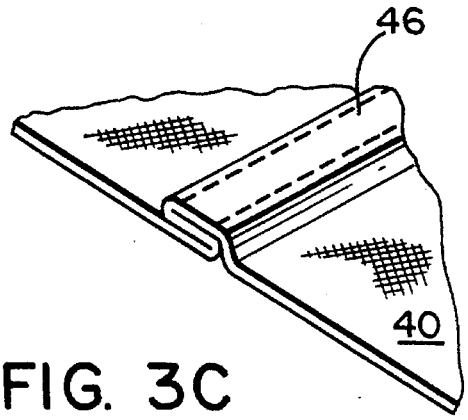

FIG. 3C illustrates the use of a foldover seam 46 which has been incorporated in bottom sheet 40 at its centerline supplying both a visual as well as tactile centerline.

Figure 3D:
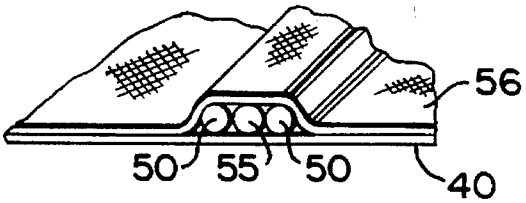
Figure 3E:
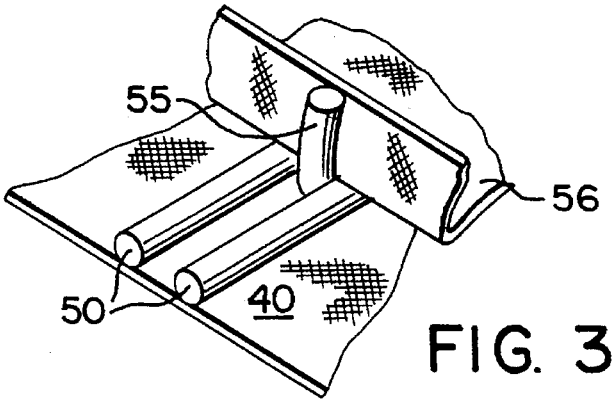

FIGS. 3D and E illustrate the use of piping 50 incorporated onto the top of bottom sheet 40 the piping 50 being separated to wedgedly accept piping 55 which is incorporated into the underside of top sheet 56. When upper piping 55 is not forced into the separation between bottom sheet piping 50, said bottom sheet piping acts to supply a visual and tactile centerline. When upper piping 55 is forced into the separation between bottom sheet piping 50 it effectively physically supplies a defined centerline separation between left and right sides of the bed in a manner similar to that illustrated in FIG. 1 with hook and loop fastener.

The foregoing details are exemplary only and are not illustrative of the principles of this invention and are not to be interpreted to limit the scope of the invention.

What we claim is:

1. The separation of left and right portions of a bed at the mid-point between said beds right and left edges, said bed having a mattress and a support thereto, comprising the covering of said mattress with a lower form fitted sheet, said form fitted sheet extending over and around said mattress' edges, said form fitted sheet having fastened thereon on the topside of said lower form fitted sheet one component of a two component fastening means extending longitudinally at the mid-point between said sheets left and right edges, said mattress being covered with a second or top sheet, said top sheet having a second component of said two component fastening means extending longitudinally at the mid-point between said top sheets left and right edges on the under surface of said top sheet, said bed's left and right portions physically being separated by joining said fastening components on said top and bottom sheets.

2. The two component fastening means according to claim 1 wherein one of said two fasting components is a hook means and the second of said fastening component a loop interlocking loop means.

3. The two component fastening means according to claim 1 wherein one of said two component fastening means is a single ridge of piping fastened to the underside of said top sheet, the second of said two component fastening means fastened to the top of said bottom sheet being two ridges of piping separated by a gap, said gap permitting said single ridge of piping on said top sheet to frictionally engage said two ridges of piping so as to interlock said top and bottom sheets.

* * * * *